US005634245A

United States Patent [19]

Rouser et al.

[11] Patent Number: 5,634,245

[45] Date of Patent: Jun. 3, 1997

[54] STRUCTURED SURFACE FASTENER

[75] Inventors: Forrest J. Rouser, Stillwater; Jon A. Kirschhoffer, White Bear Lake, both of Minn.

[73] Assignee: Minnesota Mining and Manufacturing Company, Saint Paul, Minn.

[21] Appl. No.: 502,579

[22] Filed: Jul. 14, 1995

[51] Int. Cl.[6] ..... A44B 18/00; A44B 17/00

[52] U.S. Cl. ..... 24/452; 24/442; 24/306; 24/575

[58] Field of Search ..... 24/306, 447, 452, 24/442, 448, 450; 439/350, 345, 346, 347; 128/DIG. 15

[56] References Cited

U.S. PATENT DOCUMENTS

| | | |
|---|---|---|
| 281,760 | 7/1883 | Gingras . |
| 595,510 | 12/1897 | Adams . |
| 983,093 | 1/1911 | Svenson . |
| 1,212,262 | 1/1917 | Rockwell . |
| 1,214,261 | 1/1917 | Balbach . |
| 1,342,979 | 6/1920 | Beitner . |
| 1,887,913 | 11/1932 | Bell . |
| 1,954,242 | 4/1934 | Heppenstall . |
| 1,988,868 | 1/1935 | Snyder . |
| 2,144,755 | 1/1939 | Freedman . |
| 2,206,223 | 7/1940 | Dearborn . |
| 2,435,183 | 1/1948 | Pezzella . |
| 2,461,201 | 2/1949 | Ellis . |
| 2,487,400 | 11/1949 | Tupper . |
| 2,499,898 | 3/1950 | Anderson . |
| 2,558,367 | 6/1951 | Madsen . |
| 2,632,894 | 3/1953 | Louis . |
| 2,717,437 | 9/1955 | Mestral . |
| 2,780,261 | 2/1957 | Svec et al. . |
| 2,879,018 | 3/1959 | Pence . |
| 2,895,753 | 7/1959 | Fentiman . |
| 2,926,409 | 3/1960 | Perry . |
| 3,000,658 | 9/1961 | Sprouse . |
| 3,009,235 | 11/1961 | Mestral . |
| 3,039,340 | 6/1962 | Livermont . |
| 3,054,434 | 9/1962 | Ausnit et al. . |
| 3,086,899 | 4/1963 | Smith et al. . |
| 3,101,517 | 8/1963 | Fox et al. . |
| 3,108,924 | 10/1963 | Adie . |
| 3,173,184 | 3/1965 | Ausnit . |
| 3,182,345 | 5/1965 | Smith . |
| 3,192,589 | 7/1965 | Pearson . |
| 3,198,228 | 8/1965 | Naito . |
| 3,263,292 | 8/1966 | Fekete . |
| 3,266,113 | 8/1966 | Flanagan, Jr. . |

(List continued on next page.)

FOREIGN PATENT DOCUMENTS

| | | | |
|---|---|---|---|
| 0 382 420 | 8/1990 | European Pat. Off. . | |
| 0 608 743 | 8/1994 | European Pat. Off. . | |
| 2364004 | of 1978 | France | 24/450 |
| 1 807 993 | 7/1970 | Germany . | |
| 23 52 676 | 4/1975 | Germany . | |
| 2 127 344 | 4/1984 | United Kingdom . | |

OTHER PUBLICATIONS

"The Tupperware Collection" vol. No. 1, No. 1, Summer 1986 (28 pages).

*Primary Examiner*—Peter M. Cuomo
*Assistant Examiner*—Hahn V. Tran
*Attorney, Agent, or Firm*—Gary L. Griswold; Walter N. Kirn; Stephen W. Buckingham

[57] ABSTRACT

A fastener having a first member and a second member, each member having structured surfaces thereon. The first member has two major surfaces oppositely disposed, at least a portion of each major surface having structured surfaces. The second member has at least one major surface having a structured surface. The first member is fastened to the second member when the two major surfaces of the first member are disposed between the structured surface of the second member and the elements of the structured surfaces bend and twist as well as frictionally adhere during attachment.

22 Claims, 6 Drawing Sheets

U.S. PATENT DOCUMENTS 3,335,774 8/1967 Reed .
3,353,663 11/1967 Kayser et al. .
3,369,265 2/1968 Halberstadt et al. .
3,372,442 3/1968 Ishimatsu .
3,408,705 11/1968 Kayser et al. .
3,545,048 12/1970 Daddona, Jr. et al. .
3,577,105 5/1971 Jones, Jr. .
3,604,145 9/1971 Zimmerman .
3,618,802 11/1971 Yates, Jr. .
3,633,642 1/1972 Siegel .
3,689,346 9/1972 Rowland .
3,703,739 11/1972 Young et al. .
3,730,382 5/1973 Heisler .
3,742,663 7/1973 Duskin .
3,780,469 12/1973 Hancovsky .
3,869,764 3/1975 Tamaka et al. .
3,899,805 8/1975 McMillan .
3,905,174 9/1975 Heisler .
3,955,245 5/1976 Ballin .
4,060,089 11/1977 Noiles .
4,093,009 6/1978 Iavarone et al. .
4,244,683 1/1981 Rowland .
4,329,384 5/1982 Vesley et al. .
4,330,590 5/1982 Vesley .
4,374,077 2/1983 Kerfeld .
4,403,692 9/1983 Pollacco .
4,452,356 6/1984 Dahl .
4,520,943 6/1985 Nielsen .
4,533,042 8/1985 Pollacco .
4,550,362 10/1985 Reimer ..... 439/345 X
4,576,850 3/1986 Martens .
4,581,792 4/1986 Spier .
4,646,397 3/1987 Yoshida ..... 24/442
4,775,219 10/1988 Appeldorn et al. .
4,819,309 4/1989 Behymer .
4,871,623 10/1989 Hoopman et al. .
4,875,259 10/1989 Appeldorn ..... 24/575 X
4,887,339 12/1989 Bellanger .
4,959,265 9/1990 Wood et al. .
4,979,613 12/1990 McLaughlin et al. .
5,040,275 8/1991 Eckhardt et al. ..... 24/447
5,071,363 12/1991 Reylek et al. .
5,076,288 12/1991 Millard et al. ..... 128/DIG. 15 X
5,088,164 2/1992 Wilson et al. .
5,097,570 3/1992 Gershenson .
5,113,555 5/1992 Wilson et al. .
5,201,101 4/1993 Rouser et al. ..... 24/575
5,212,855 5/1993 McGanty ..... 24/452 X
5,344,177 9/1994 Rouser et al. .
5,360,270 11/1994 Appeldorn et al. .

STRUCTURED SURFACE FASTENER

FIELD OF THE INVENTION

The present invention generally relates to fasteners using structured surfaces. More particularly, the present invention relates to a fastener having a dual sided structured surface film on a first member and two single sided structured surface films on a second member.

BACKGROUND OF THE INVENTION

There are a number of ways known by those skilled in the art to fasten, couple or connect articles. For example, U.S. Pat. Nos. 2,717,437 and 3,009,235 to Mestra teach hooks and loops whereby when the hooks are brought into contact with the loops, the loops interlock with the hooks. U.S. Pat. No. 2,499,898 to Anderson, U.S. Pat. No. 3,192,589 to Pearson, U.S. Pat. No. 3,266,113 to Flanagan, Jr., U.S. Pat. No. 3,408,705 to Kayser et al., and U.S. Pat. No. 4,520,943 to Nielson teach a plurality of macro asperities or protrusions, that function as an attachment means when brought into contact with similarly shaped macro asperities with correspondingly shaped recesses. Additionally, fasteners utilizing a plurality of longitudinally extending rib and groove elements which deform and mechanically interfere and resiliently interlock with each other have been disclosed in U.S. Pat. No. 2,144,755 to Freedman, U.S. Pat. No. 2,558,367 to Madsen, U.S. Pat. No. 2,780,261 to Svec et al., U.S. Pat. No. 3,054,434 to Ausnit et at., U.S. Pat. No. 3,173,184 to Ausnit, U.S. Pat. No. 3,198,228 to Naito and U.S. Pat. No. 3,633,642 to Siegel.

U.S. Pat. No. 4,875,259 to Appeldorn discloses several intermeshable articles. Some of the species of intermeshable articles disclosed in U.S. Pat. No. 4,875,259 require alignment before pressing the structured surfaces together. U.S. Pat. No. 5,201,101 to Rouser et al. discloses a method of fastening a pair of articles each having a structured surface, wherein the articles may be misaligned, thereby twisting elements on the structured surface and fastening the articles. The misaligned articles are fastened along the major surfaces having the structured surfaces, and have a higher peel strength than articles attached when the articles are aligned.

SUMMARY OF THE INVENTION

The present invention is directed to a fastener utilizing a plurality of structured surfaces and a method for fastening the fastener. The fastener has a first member having a two structured surfaces thereon, and a second member having at least one single sided structured surfaces. More specifically, the first member has a first and second major surface, the second major surface being opposite the first major surface. The second member has at least one major surface, and preferably two major surfaces. Each of the major surfaces of the first and second members have a structured surface including a plurality of tapered elements. The first member is placed between the structured surfaces of the second member such that the longitudinal axis formed by the plurality of tapered elements on the first member is situated at an angle relative to the longitudinal axis formed by the plurality of tapered elements on the second member. When the two members are fastened together, at least two of the tapered elements between each of the two fastened portions of the first and second members are torsionally twisted relative to their relaxed, unfastened position, and the inclined sides of one of the first and second member's tapered elements are frictionally adhered to at least one of the inclined sides of the other of the first and second member's tapered elements between each of the two fastened portions between the first and second member.

A method is also described including the steps of: (1) disposing the o longitudinal axis of a first major surface of the first member of the fastener at a first angle (theta θ) relative to the longitudinal axis of first major surface of second member; (2) pressing the structured surfaces of the first major surface of the first member and first major surface of second member together; (3) disposing the longitudinal axis of the second major surface of first member at a second angle (psi ψ) relative to the longitudinal axis of the second major surface of second member; and (4) then pressing the structured surfaces of the second major surface of the first member and the second major surface of the second member. After the structured surfaces are pressed together, (1) at least one of the tapered elements on each of the first major surfaces and the second major surfaces of the first or the second members are axially bent and torsionally flexed relative to their relaxed, unfastened position, and (2) the inclined sides of the first members' tapered elements are frictionally adhered to the inclined sides of the second members' tapered elements.

BRIEF DESCRIPTION OF THE DRAWINGS

The present invention will be more fully described with reference to the accompanying drawings wherein like reference numerals identify corresponding components, and.

DETAILED DESCRIPTION OF A PREFERRED EMBODIMENT

Figure 1:
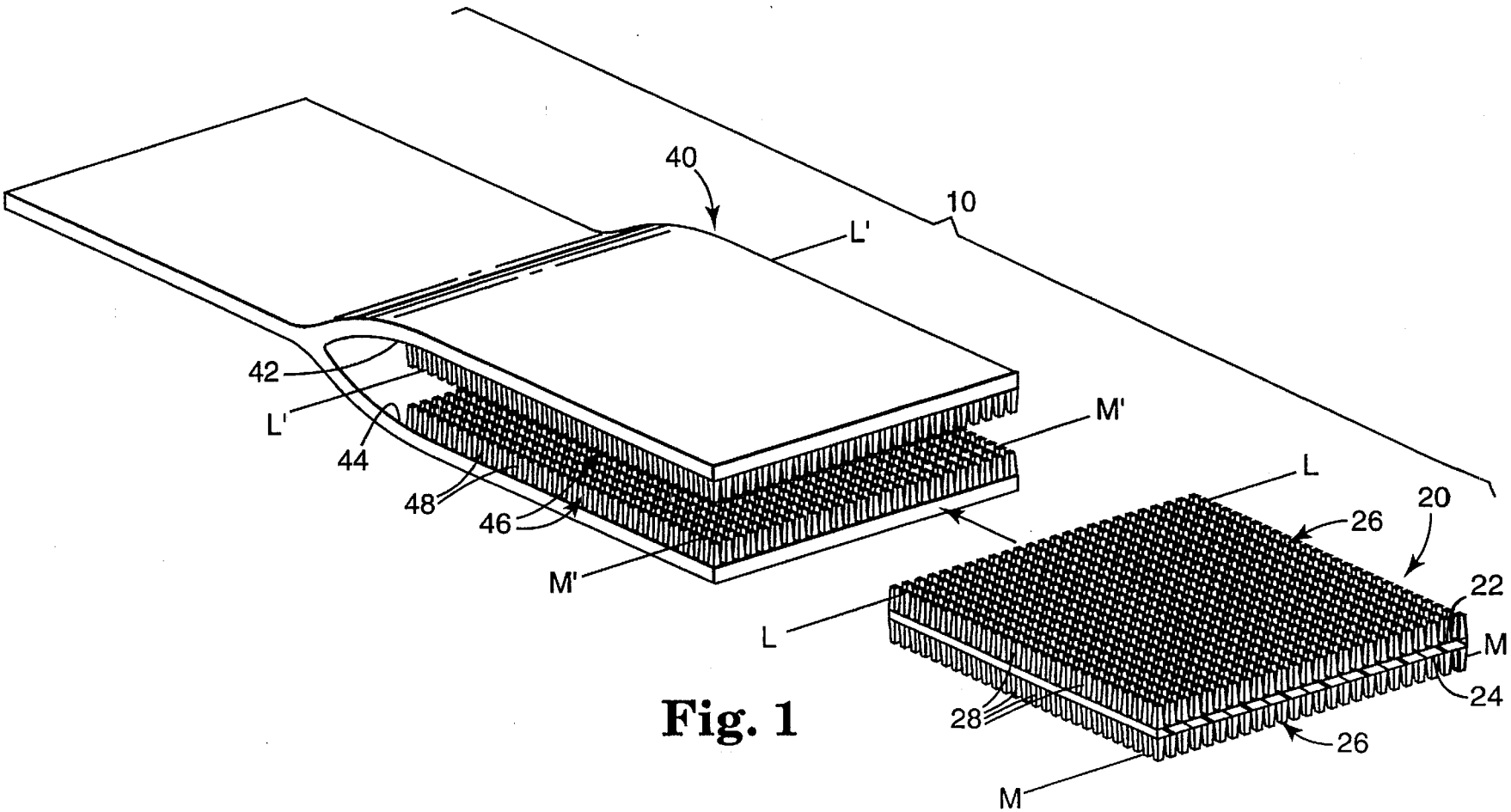
FIG. 1 is a perspective view of separated first and second members of the fastener of the present invention with their longitudinal axes shown.
Figure 2:
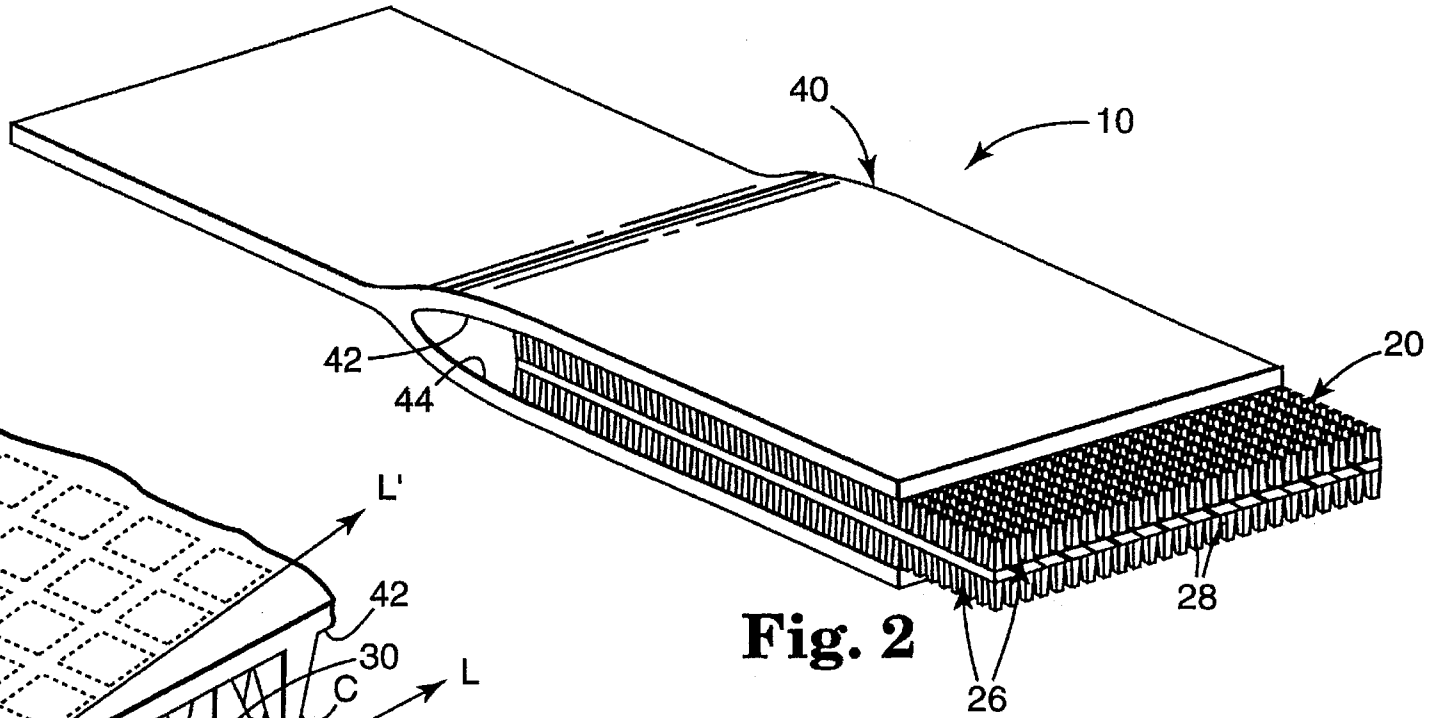
FIG. 2 is a respective view of the first and second members of the fastener shown in FIG. 1 after they have been pressed together and fastened according to the present invention.
Figure 3:
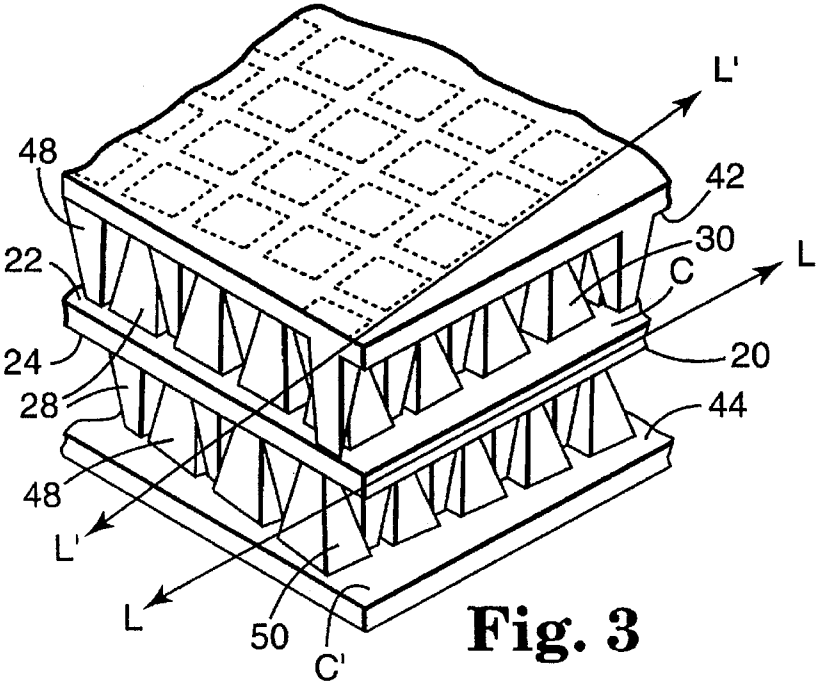
FIG. 3 is an enlarged perspective sectional view of the first and second members after they have been pressed together and fastened, illustrating misaligned longitudinal axes between one major surface of the first member and one major surface of the second member.

Referring now to FIGS. 1, 2 and 3, there is shown a first embodiment of the fastener of the present invention, generally designated by the reference character 10. Fastener 10 includes a first member 20 having first and second major surfaces, 22 and 24, respectively, each of which includes a structured surface 26. The structured surface 26 includes a plurality of tapered elements 28. Each element 28 has at least one side 30 inclined relative to a common plane C at an angle sufficient to form a taper. The tapered elements 28 are situated to form a plurality of imaginary axes including a first major surface longitudinal axis L and a second major surface longitudinal axis M.

Fastener 10 also includes a second member 40 having at least one major surface, and preferably having first and second major surfaces, 42 and 44, respectively, each of which includes a structured surface 46. The structured surface 46 includes a plurality of tapered elements 48. The tapered elements 48 each have at least one side 50 inclined relative to common plane C' at an angle sufficient to form a taper. The tapered elements 48 are situated to form a plurality of imaginary axes including a second member longitudinal axis L' and a second major surface longitudinal axis M', in embodiments where second member has two major surfaces. The tapered elements 28 and 48 may, for example, have a shape in an unfastened position such as that shown in FIG. 1. In an embodiment where second member only has one major surface, second member must be folded, such that the one major surface performs the function of the first and second major surfaces shown in FIGS. 1 and 2.

Preferably the axes L, M, and L', M' are situated generally between periodic arrays or rows of tapered elements (e.g. 15 or 25) such that the rows are symmetrical about the axes L, M, L', or M' (see e.g. FIGS. 1, 2 and 3). However, alternatively, the axes may be situated between periodic rows of tapered elements that are not symmetrical about the axes (see e.g. axis A and FIG. 12). It should be noted that it is within the scope of the invention that the tapered elements need not be periodic and may even be arranged randomly. In a case where the tapered elements do not form a periodic arrangement (e.g. where they are randomly arranged), an imaginary axis may be arbitrarily established. Moreover, first major surface 22 of first member 20 could have a first axis while second major surface 24 of first member 20 could have a second axis. Similarly, the longitudinal axes of first and second major surfaces of second member 40 need not be the same. It is preferable, however, that the axis of first major surface 22 of first member 20 is misaligned with the axis of first major surface 42 of second member 40 and the axis of second major surface 24 of first member 20 is misaligned with the axis of second major surface 44 of second member 40.

The first 20 and second 40 members of fastener 10 are fastened together by a method according to the present invention including the steps of: (1) disposing the longitudinal axis L of first major surface 22 of first member 20 at a first angle (theta θ) relative to the longitudinal axis L' of first major surface 42 of second member 40 (FIG. 3); (2) pressing the structured surfaces 26 and 46 of first major surface 22 of first member 20 and first major surface 42 of second member 40 together (FIG. 3); (3) disposing the longitudinal axis M of second major surface 24 of first member 20 at a second angle (psi ψ) relative to the longitudinal axis M' of second major surface 44 of second member 40; and (4) then pressing the structured surfaces 26 and 46 of the second major surface 24 of first member 20 and the second major surface 44 of second member 40 the angles θ and ϕ can range from zero (0) to forty-five (45) degrees. After the structured surfaces 26 and 46 are pressed together, (1) at least one of the tapered elements 28 or 48 on each of the first major surfaces and the second major surfaces of the first 20 or the second 40 members are is axially bent and torsionally flexed relative to their relaxed, unfastened position (e.g. as shown in FIG. 1), and (2) the inclined sides 30 of the first members' tapered elements 28 are frictionally adhered to the inclined sides 50 of the second members' tapered elements 48. Moreover, if the width of the major surfaces 42 and 44 of second member 40 exceed the width of the major surfaces 22 and 24 of first member 20, then the structured surface portion of the first and second major surfaces 42 and 44 of second member 40 that exceed the width of first member may also be pressed together to form another fastened portion. Similarly, the structured surface of first major surface of first member can be fastened to the structured surface of second major surface of first member to form a fastened portion. For example, in FIG. 1, structured surface 26 on first major surface 22 can be folded over and fastened to structured surface 26 on second major surface 24. Thus, a single strip of film having the structure of the first member can provide fastening.

In an embodiment where second member 40 only has one major surface, the two members are fastened together by a method according to the present invention including the steps of: (1) disposing the longitudinal axis L of the first major surface of the first member at a first angle (theta θ) relative to the longitudinal axis L' of a first portion of the major surface of second member; (2) pressing the structured surfaces of the first major surface of the first member and the first portion of the major surface of second member together; (3) disposing the longitudinal axis M of second major surface of first member at a second angle (psi ψ) relative to the longitudinal axis L' of the second portion of the major surface of second member; and (4) then pressing the structured surfaces of the second major surface of the first member and the second portion of the major surface of the second member.

As used in this application, the phrase "axially bent" is defined as follows: The tapered elements 28 and 48 have a relaxed shape in an unfastened position such as that shown in FIG. 1. There are no external forces acting on the tapered elements 28 or 48 in the unfastened position. In the unfastened position, the tapered elements (e.g. 28 and 48) have an imaginary longitudinal axis T (FIG. 6) which passes through the geometric center or centroid of the tapered element (e.g. 28 or 48). For example, in FIG. 6, because of the symmetrical shape of the tapered elements and the assumption that the tapered elements have a constant density, the longitudinal axis T is perpendicular to the common plane C or C'. In this application when it is said that the tapered elements are "axially bent", it is meant that the elements are deflected or deformed to a shape having an imaginary longitudinal axis T' (FIG. 6) passing through the geometric center of the deformed element which is at an angle or otherwise displaced relative to the relaxed position of the imaginary longitudinal axis T in the unfastened state.

As used in this application, torsionally flexed or twisted is defined as follows: The tapered elements 28 or 48 have a relaxed orientation in planes perpendicular to the imaginary longitudinal axis (see FIG. 2) in an unfastened state. In this application, when it is said that the tapered elements are torsionally twisted, it is meant that the elements are radially displaced relative to their orientation in the unfastened state or position using the axis T and a corner of surface 52 as references.

Figure 6:
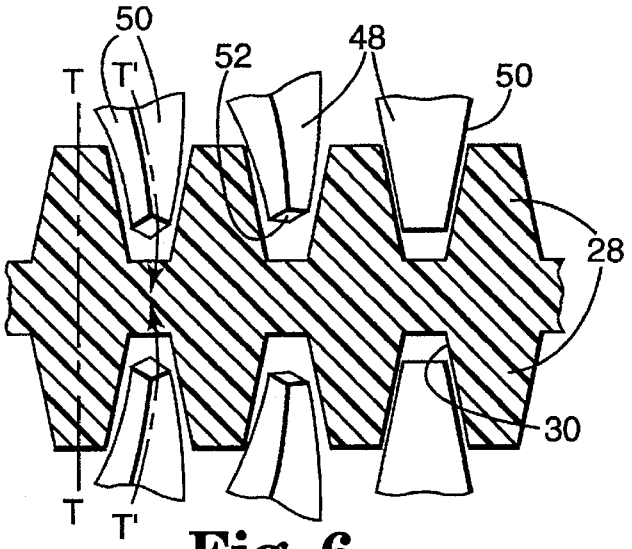
FIG. 6 shows a partial side cross-sectional view of the fastener.
Figure 8:
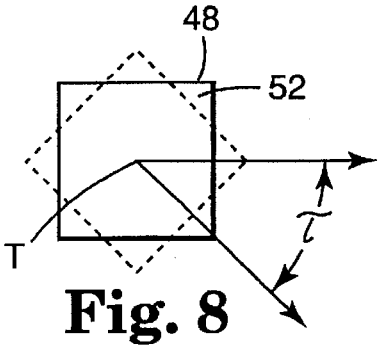
FIG. 8 is a schematic representation of the top of a flexible tapered element in an unfastened, relaxed state (solid lines) and a twisted, fastened state (dashed lines)
Figure 10:
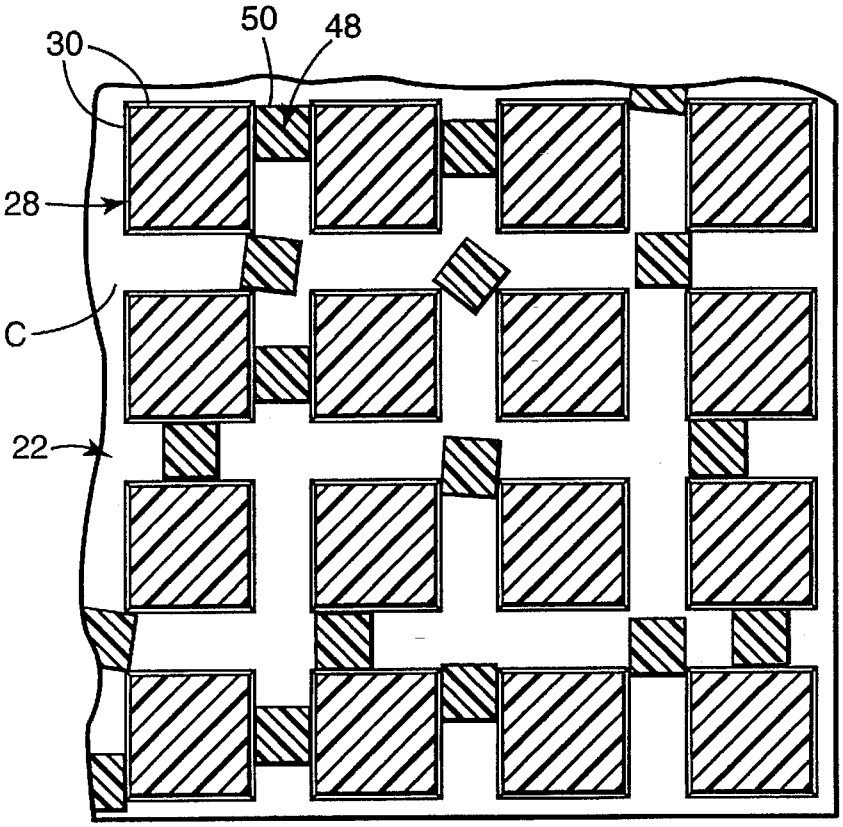
FIG. 10 is an enlarged cross-section of a two fastened major surfaces.

Referring now to FIGS. 6, 8 and 10 there is shown an example of the first embodiment of the fastener 10 shown in FIGS. 1 and 2 wherein the second member 40 is constructed from a relatively flexible material so that the tapered elements 48 may bend and the first member 20 is constructed from a relatively rigid material so that the elements 28 do not bend. As best seen in FIG. 6, the shape of the first members' tapered elements 28 remains generally the same in the fastened and in the unfastened position. However, the second members' tapered elements 48 both axially bend and twist. Conversely, first member 20 may be constructed from a relatively flexible material and second member 40 may be constructed from a relatively rigid material. Moreover, first major surface 22 of first member 20 could be constructed of a rigid material while second major surface 24 of first member 20 could be constructed of a relatively flexible material. In such an embodiment, first major surface 42 of second member 40 would be constructed of a relatively flexible material and second major surface 44 of second member 40 would be constructed of a relatively rigid material.

Referring to the tapered elements 48 in FIG. 6, the elements 48 are deflected or deformed to a shape having an imaginary longitudinal axis T' passing through the geometric center of the deformed element 48 which is at an angle relative to the relaxed position of the imaginary longitudinal axis T (not shown for the element 48 in FIG. 6) in the unfastened position. Compare the positions of the imaginary axes T and T' in FIG. 6.

The elements 48 shown in FIGS. 6 and 8 also torsionally twist. As best seen schematically in FIG. 8, element has an orientation in planes perpendicular to the imaginary longitudinal axis T in an unfastened state (solid lines), such as the plane which passes through the top surface 52. In the fastened position, the tapered element 48 is torsionally displaced or "twisted" (dashed lines). The element 48 is radially or torsionally displaced the angle tau ($\tau$) relative to its orientation in the unfastened state or position using the axis T and a corner of surface 52 as references.

It should be noted that the angle tau does not necessarily correspond to the angle theta for the fastener. Instead, the angle tau may vary widely for different tapered elements 28 or 48 on the same first and second members. If one of the members 20 or 40 is constructed from a relatively rigid material and the other article is constructed from a flexible material (see FIG. 6), the angle tau for the rigid material is generally zero. Alternatively each of the first and second members 20 or 40 may be constructed from a flexible material.

Referring now to FIGS. 1, 2 and 3, the angle theta $\theta$ is the angle between the axes L and L' of first major surfaces of first and second member, respectively. The angle theta $\theta$ is generally between more than zero (0) and less than about twenty (20) degrees and is preferably seven-and-one-half (7.5) degrees for reasons set forth below. Similarly, angle psi $\psi$ is the angle between the axes M and M' of the second major surfaces of first and second member, respectively. Angle psi $\psi$ also is generally between more than zero (0) and less than twenty (20) degrees and is preferably seven-and-one-half (7.5) degrees.

When the first 20 and second 40 members are brought together they adhere to one another, since the inclined sides 30 of the first members' tapered elements 28 frictionally adhere to the inclined sides 50 of the second member's tapered elements 48. Because the first and second members 20 and 40 may be attached to one another without first aligning the members, a user may randomly align the members and then press them together. The multipositionable feature of fastener 10 is a convenient characteristic for a user.

The structured surfaces 26 and 46 of the first 20 and second 40 members generally comprise solid pyramidal-shaped elements having a polygonal-shaped cross-section. The phrase pyramidal-shaped elements is used herein to include truncated versions such as the frusto-pyramidal-shaped elements 28 and 48 shown in FIGS. 1, 2 and 3. The pyramidal-shaped elements 28 and 48 generally include a polygonal-shaped cross-section such as the square shown in FIGS. 1, 2 and 3. Alternatively, the cross-section may be rectangular, regular hexagonal, hexagonal, triangular, circular, elliptical, combinations thereof, or combinations of straight and arcuate line segments.

The particular material used to construct the first and second members 20 and 40 may be any suitable material so long as at least one of the materials affords a flexible tapered element 28 or 48 that may axially bend and torsionally twist or flex. Various materials may be used such as but not limited to commercially available acrylics, vinyls, polymers (including electron beam or radiation cured polymers), polyethylenes and polycarbonates. Particular examples include polymethyl methacrylate, polystyrene, non-rigid polyvinyl chloride with plasticizers, and biaxially-oriented polyethylene terephthalate. Additionally, the material may be biodegradable, transparent or translucent, electrically conductive or magnetic according to the particular application. Additionally, any of the materials mentioned in U.S. Pat. No. 4,875,259 may be used.

Figure 7:
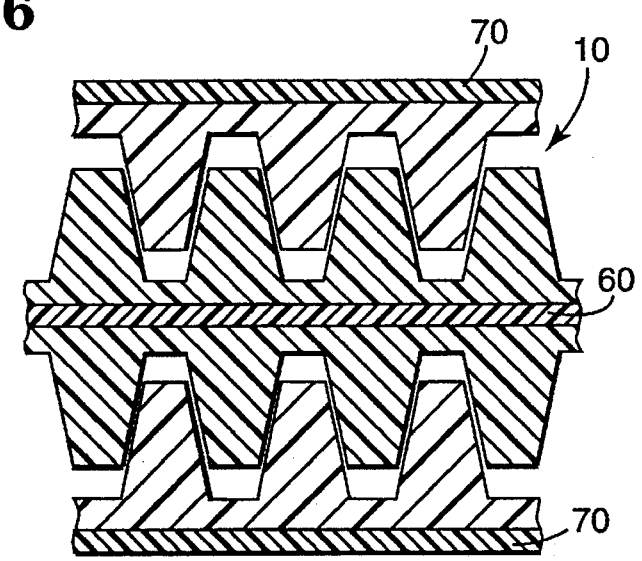
FIG. 7 is a partial side cross-sectional view of another embodiment of the fastener of the present invention showing a backing on the first and second members.

Referring to FIG. 7, another embodiment of the present invention is shown. When fastener 10 is constructed of a material such as acrylics, vinyls and polymers, the fastener often exhibits the property of elasticity, which may be desirable. In some cases, however, it is desirable to provide a backing to prevent or limit the elasticity of the fastener or to provide additional structural integrity to the fastener. Backing 60 and 70, for first and second members, respectively, may be any suitable material, such as a nonwoven web, a film, a foam or a woven fabric. Nonwoven webs may be manufactured by any of the well known methods for manufacturing nonwovens including melt-blowing, spin-bonding, carding, aerodynamic entanglement, hydroentangling, needle-tacking etc. Other fabrics, films and foams are also suitable for constructing the backing of the fastener of the present invention. For example, films such as polyurethane, polyester, or polyether block amide films are readily available and are suitable for the invention. Likewise, foams such as polyvinylchloride, polyethylene and polyurethane foams are also suited for the invention. The backing is preferably molded into the first or second member during a molding process, although other methods of embedding or affixing the backing to the members of the fastener, such as with adhesive, are also contemplated by the present invention.

EXAMPLE 1

Figure 9:
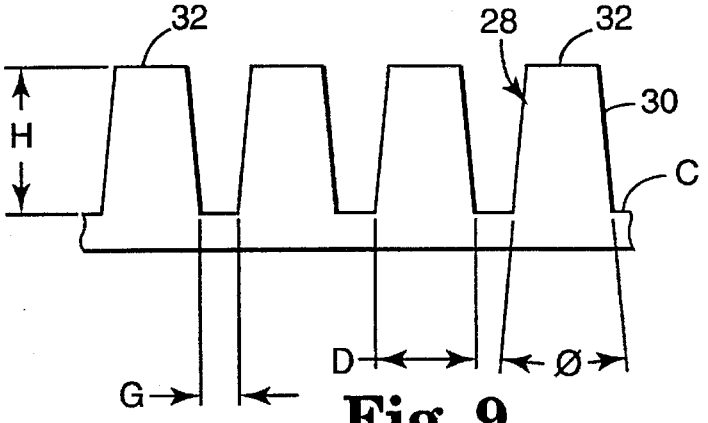
FIG. 9 is a sectional view of the structured surface of FIG. 11, with parts broken away to illustrate details of the geometry of the structured surface.
Figure 11:
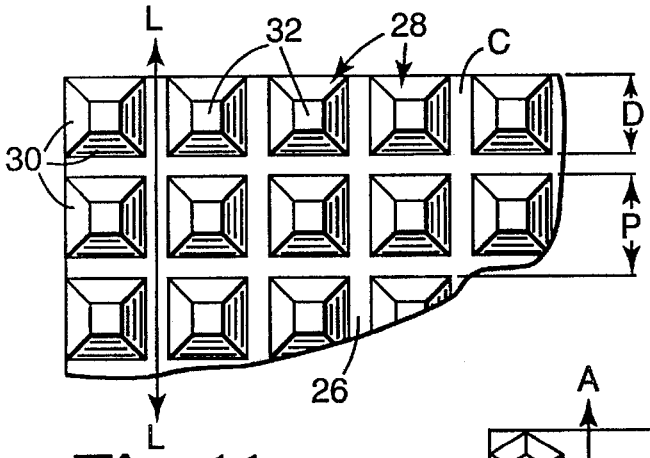
FIG. 11 is a plan view of an embodiment of frusto-pyramidal-shaped tapered elements on the structured surface of one of the major surfaces of the fastener according to the present invention which illustrates a square cross-section for the tapered members.

An example of a first embodiment of a major surface of either the first or second member of fastener 10 is shown in FIGS. 9 and 11. The tapered elements 28 or 48 include top surfaces or portions 32 or 52 which define a height H measured from the common plane C.

The first and second members in this example comprise a rectangular strip of PVC film with plasticizers. Second member 40 was flexible and had integral, uniform flexible elements 48. The dimensions of the second member was approximately 12.7 centimeters, (5 inches") long, about 2.54 centimeters. (1 inch") wide, and with total thickness of about 1.0–1.27 millimeters. (40–50 mils). First member 20 was also flexible with integral, uniform flexible elements 28. The dimensions of first member were similar to the second member, except the total thickness was between 1.27–1.78 mm (50–70 mils).

First and second members 20 and 40 comprised polyvinyl chloride constructed from clear #516 PVC pellets obtained from Alpha Chemical and Plastics Corporation 9635 Industrial Drive, Pineville, N.C. (manufacturer no. 2215-80). Second member 40 had a first broad smooth surface, and a second broad structured surface (e.g. 26) wherein the structure was of the orthogonal type having two mutually perpendicular axes of periodicity, and two longitudinal axes L' and M' (as shown in FIGS. 1, 2, and 11). First member 20 has a first and second broad structured surface, oppositely disposed, wherein the structures were similar to those of the second broad structured surface of second member 40, and an example of such a structured surface is shown in FIGS. 9 and 11.

The structured surfaces 26 and 46 had about a 0.63 millimeter or 25 mil groove depth or height H, a 9 degree 36 minute (rounded to 10°) included angle between tapered surfaces 30 or 50(shown as the angle phi in FIG. 9), a pitch or lattice constant of about 0.33 millimeters, (13.08 mils) (shown as P in FIG. 11), top dimensions of approximately 0.12 by 0.12 mm. (4.86 by 4.86 mils) (e.g. the length of the sides of the top surfaces 32 or 52), and a width at the base of grooves of about 0.23 millimeters, (9.06 mils) (shown in FIG. 11 as the Diameter D). The distance G shown in FIG. 9 is simply P - D or 0.10 millimeters.

When polyvinyl chloride made from clear #516 PVC pellets obtained from Alpha Chemical and Plastics Corporation 9635 Industrial Drive, Pineville, N.C. (manufacturer no. 2215-80) was used, it was found that the flexible elements with the above mentioned dimensions twisted and bent sufficiently to enable the first and second members 20 and 40 to be fastened in a plurality of angular orientations.

Numerous factors affect the ability of the tapered elements 28 or 48 to bend or twist when the first and second members 20 and 40 are pressed together. For example, the material characteristics, the cross sectional shape of the elements 28 or 25 (e.g. square or rectangular etc.), the angle between tapered surfaces (e.g. the angle phi), the height H to diameter D ratio H/D and the pitch P to diameter D ratio P/D are all believed to affect the ability of the tapered elements to bend and twist.

All other factors held constant, the height H to diameter D ratio should be sufficient to afford bending and twisting of the elements 28 or 48. In example 1, the height to diameter ratio H/D was (0.63 millimeters/0.23 millimeters)=2.74. This H/D ratio for this material was found to work well and to provide for attachment at different angular orientations. All other factors held constant, the H/D ratio should be numerically large enough to afford flexing and twisting of the element 28 and 48. However, if the ratio H/D is too large, then the tapered elements 28 and 48 bend excessively and tend to interfere with each other, thereby impeding attachment of members 20 and 40. If the ratio H/D is too small, then the tapered elements 28 or 48 tend to become too rigid to twist and bend and thus "bending" attachment of members 20 and 40 is deleteriously affected for that material.

Additionally, all other factors held constant, the pitch P to diameter D ratio P/D should be sufficient to afford bending and twisting of the elements 28 or 48. For example, in example 1, the P/D ratio is 0.33/0.23=1.43. This P/D ratio for this example was found to work well and to provide for attachment at different angular orientations. All other factors held constant, the P/D ratio should be numerically large enough to afford flexing and twisting of the element 28 or 48. However, if the ratio P/D is too large, then it is believed that the elements 28 and 48 will not twist and bend and will instead remain in or return to their unfastened position. If the ratio P/D is too small, then the tapered elements 28 and 48 tend to become too closely spaced and tend to excessively interfere with each other so that little or no bending or twisting occurs.

The fastener 10 described in Example 1 was constructed in the following manner. First, a Pasadena Hydraulics, Inc., 50 Ton Model Compression Molding Press (generally available from Pasadena Hydraulics, Inc. of Pasadena, Calif.) was used. The molding surfaces were constructed to provide members having the dimensions set forth above in Example 1. The PVC material described above was used. The molding surfaces were constructed by first diamond cutting a UV curable polymer to provide a molding sample major surface having the dimensions and shape set forth above in Example 1. Optionally, any suitable acrylic plastic material may be used. Diamond turning equipment such as the Moore Special Tool Co. Model M-40 or the Pneumo Co. Model SS-156 (e.g. SN 76936) may be used to construct the molding sample major surface.

Of course, it will be appreciated by those skilled in the art that the fastener of the present invention are not necessarily individually machined but are instead produced by a replication process. Thus, to construct the molding surfaces, the molding sample mentioned above was used in a conventional electroforming process (similar to the electroforming process mentioned in U.S. Pat. No. 4,871,623 the entire contents of which are herein expressly incorporated by reference) to provide the suitable molding surface. For example, a nickel molding surface may be electroformed from the acrylic plastic sample major surface mentioned above.

Figure 15:
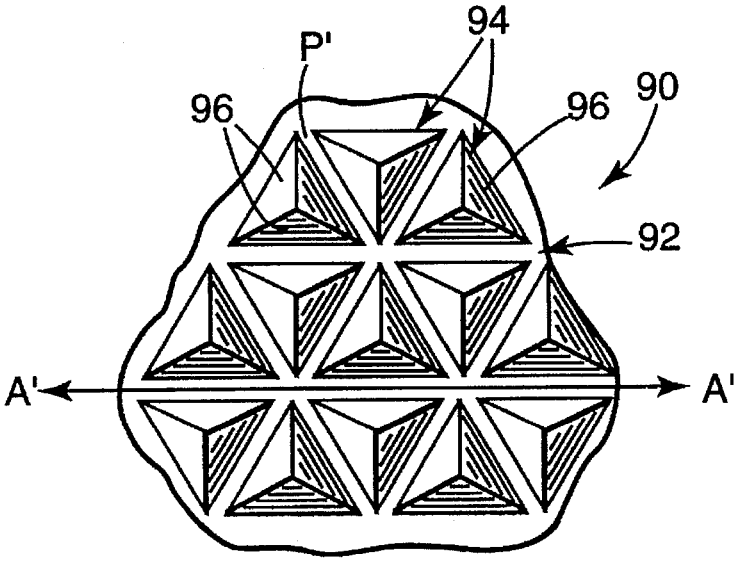
FIG. 15 is a plan view of another embodiment of one of the fastened articles according to the present invention, illustrating a triangular cross-section for the tapered members.

Optionally, in some structured surface designs, such as illustrated in FIG. 15, it may be advantageous to directly machine a molding surface from a metal, molding surface material, with no electroforming process. Another option may be to initially machine a surface similar to the desired molding surface in a metal material, then molding a molding sample major surface from the metal surface, and then electroforming the molding surface using the molding sample major surface.

Once the molding surfaces were constructed, the PVC pellets were then initially placed between the two molding surfaces of the Compression Molding Press. The molding surfaces of the press were heated to 350 degrees Fahrenheit, after which a force of about 4350 pounds per square inch was exerted on the molding surfaces for a time period of two minutes. After two minutes, the force was increased to 45,000 pounds per square inch for a time period of two minutes.

The molding surfaces were then cooled to 100 degrees Fahrenheit while a force of 45,000 pounds per square inch was maintained for a time period often minutes. After the ten minute time period, the 45,000 pounds per square inch force was removed. The PVC article was then removed from the molding surfaces.

There are several other methods which may be used to produce the fastener according to the present invention which are known in the art, such as the methods disclosed in U.S. Pat. Nos. 3,689,346 and 4,244,683 to Rowland; U.S. Pat. No. 4,875,259 to Appeldorn; U.S. Pat. No. 4,576,850 to Mertens; and U.K. Patent Application No. GB 2,127,344 A to Pricone et al.

As stated above, the cross-section of the tapered elements need not be square. The cross-section of the tapered elements may comprise any polygonal shape including combinations of arcuate or straight lines, including but not limited to hexagons, triangles, ellipses and circles.

Figure 12:
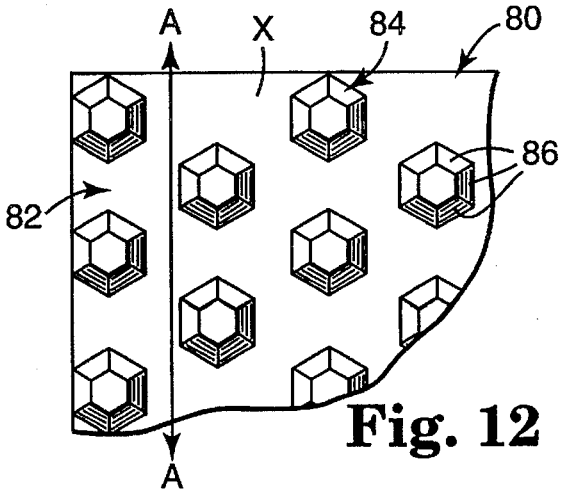
FIG. 12 is a plan view of another embodiment of one of the major surfaces of the fastener according to the present invention, illustrating a regular hexagonal cross-section for the tapered members.

FIG. 12 illustrates a second alternative embodiment of one of the major surfaces of either the first or second member of the fastener according to the present invention generally designated by the reference character 80 which has many parts that are essentially the same as the parts of the first and second members 20 and 40.

Like the first and second members 20 and 40, the major surfaces 80 includes a structured surface 82 having a plurality of tapered elements 84. Each element 84 has sides 86 inclined relative to a common plane X at an angle sufficient to form a taper. The tapered elements 84 are situated to form a plurality of axes including a first major surface longitudinal axis A. Unlike the tapered elements 28 and 48, the cross-section of the tapered elements 84 are regular hexagons, and the tapered elements 84 are not arranged such that they are symmetrical about the axis A.

FIG. 15 illustrates a third alternative embodiment of one of the major surfaces of the first or second members of fastener 10 according to the present invention generally designated by the reference character 90 which has many parts that are essentially the same as the parts of the major surface 80.

Like the major surface 80, major surface 90 includes a structured surface 92 having a plurality of tapered elements 94. Each dement 94 has sides 96 inclined relative to a common plane P' at an angle sufficient to form a taper. The tapered elements 94 are situated to form a plurality of axes including a first major surface longitudinal axis A'. Unlike the tapered elements 84, the cross-section of the tapered elements 94 are triangles.

It should be noted that the tapered elements 28, 48, 84, or 94 of one major surface may be positive elements (e.g. solid elements which project from their respective common plane C) and the elements of the other major surface may be negative elements (e.g. cavities which are recessed from their respective common plane C) so that the sides of the positive elements may engage with the sides of the negative elements to adhere thereto. Additionally, it should be appreciated that the cross-sectional shape of the tapered elements of the first major surface may be dissimilar to the cross-sectional shape of the tapered elements of the second major surface. For example, the hexagonal shaped tapered elements shown in FIG. 12 may be positive elements and may engage with appropriately arranged negative, triangular shaped elements (see FIG. 15).

APPLICATION AND USE

Figure 5:
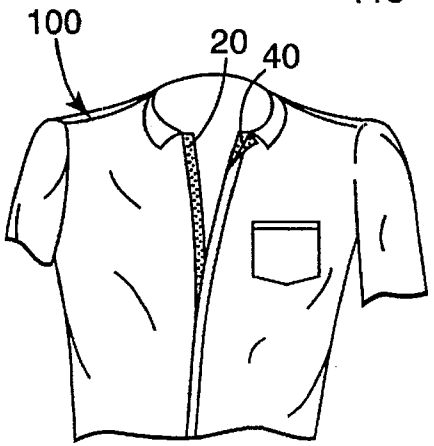
FIG. 5 shows the fastener of the present invention used as a closure on a shirt.

FIG. 5 illustrates an example of many applications for the present invention. Fastener 10 may be incorporated into many types of articles, such as clothing, shoes, tents, backpacks, bags etc. for use as a closure in the article. FIG. 5 shows fastener 10 incorporated into shirt 100. First member 20 of fastener 10 is affixed to a first side of shirt 100 at a portion of shirt 100 needing closure and second member 40 is affixed to a second side of shirt 100. In some situations, it is preferable that the longitudinal axes of the structured surfaces of the first and second members are misaligned. In such situations, the side of first member 20 may form an angle theta with the longitudinal axis (e.g. L and M) of the structured surface of first member 20 and the sides of second member 40 may be generally parallel to the longitudinal axis (e.g. L' and M') of the structured surface of second member 40. Thus, when first member 20 is pressed between the first and second major surfaces of second member 40, the user need only align the side of first member 20 with the side of second member 40 to afford a convenient and quick approximation of the optimal, preferred angle.

Figure 4:
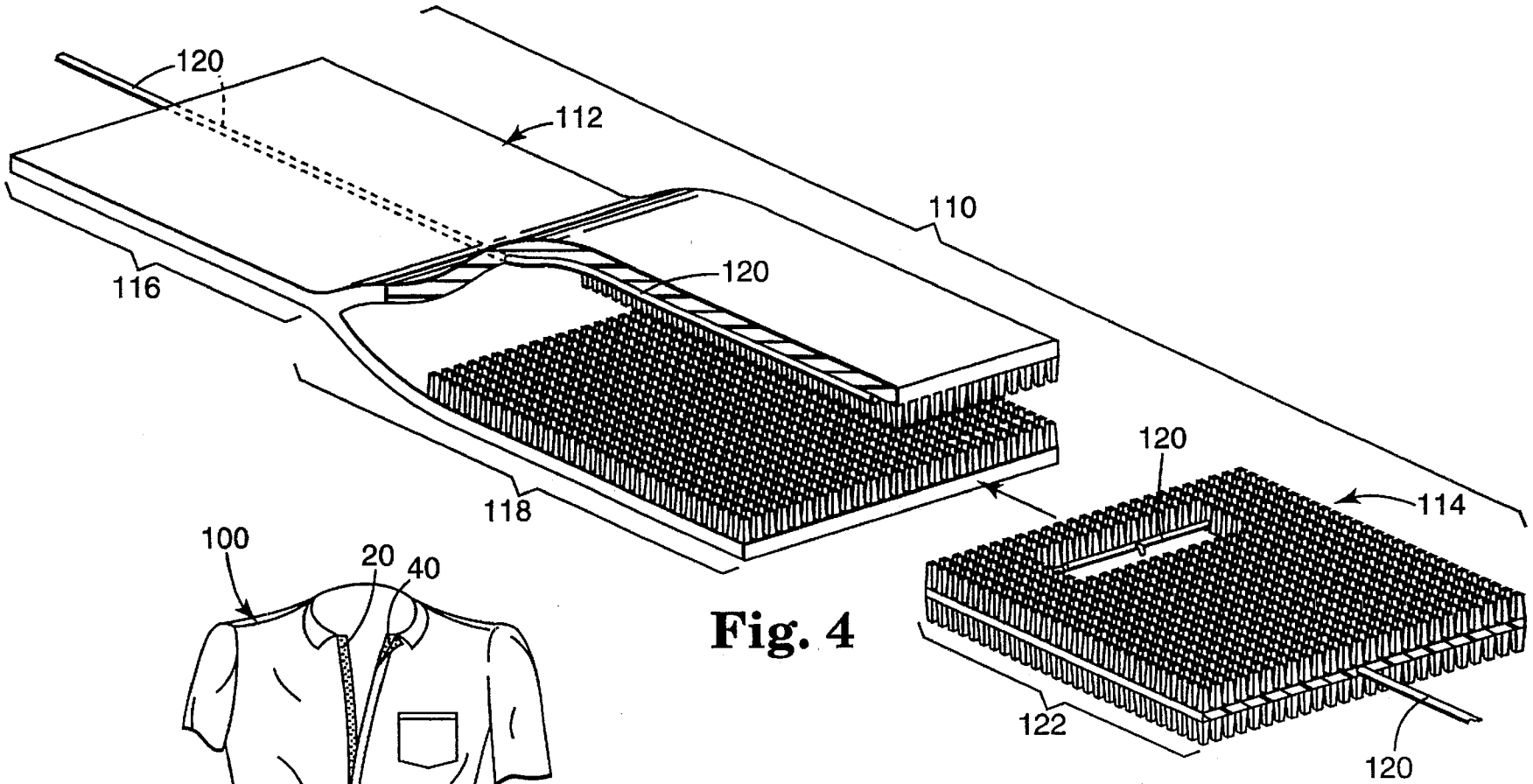
FIG. 4 is a perspective view of separated first and second members of the fastener of the present invention adapted to function as an electrical connector.

FIG. 4 shows another example of an application for the fastener of the present invention. The fastener may be used as a component in an electrical connector. Electrical connector 110 comprises a fastener portion, having first member 112 and second member 114, similar to the fastener shown in FIG. 1. First member 112 has electrically conductive material 120 embedded in a first portion 116 of first member 112, which acts as a lead for one half of the electrical conductor. The electrically conductive material is exposed in at least one second portion 118 of first member 112. The electrically conductive material is exposed on the common plane of one of the major surfaces of the first member, preferably between the rows of tapered elements. The electrically conductive material may be exposed on both the common planes of the first and second major surfaces in another embodiment. While in the electrical connector shown in FIG. 4 has an embedded portion and an exposed portion, it is not necessary for any of the electrically conductive material to be embedded within the fastening portion.

Second member 114 also has electrically conductive material 120 embedded in a first portion 122 of second member 124, although it is not necessary to embed the electrically conductive material, which acts as a lead for the other half of the electrical conductor. The electrically conductive material is exposed in at least one second portion of second member 114. The electrically conductive material 120 is exposed on the common plane of one of the major surfaces of the second member, preferably between the rows of tapered elements. In FIG. 4, some tapered elements are not shown to better show the exposed portion of electrically conductive material 120. The exposed electrically conductive material 120 of the second member 114 preferably is situated in a perpendicular relationship to the exposed electrically conductive material of the first member when the first and second members are fastened. In the embodiment where the electrically conductive material may be exposed on both the common planes of the first and second major surfaces of the first member, the electrically conductive material of the second member is also exposed on its first and second major surfaces. An electrical connection is formed between the electrically conductive materials of the first and second members when first member 112 is fastened to second member 114 using the previously described method of fastening the fastener shown in FIGS. 1 and 2.

TEST RESULTS

Figure 13:
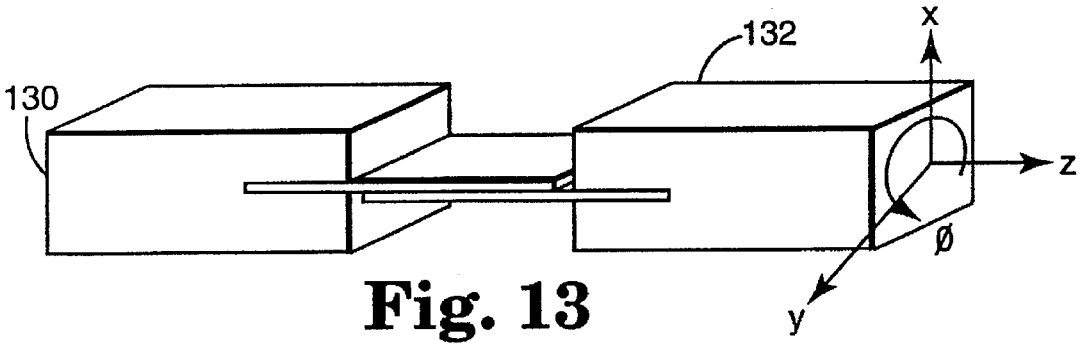
FIGS. 13 and 14 are a schematic perspective views illustrating how the comparative lateral force separation measurements and twist angle separation measurements were performed.
Figure 14:
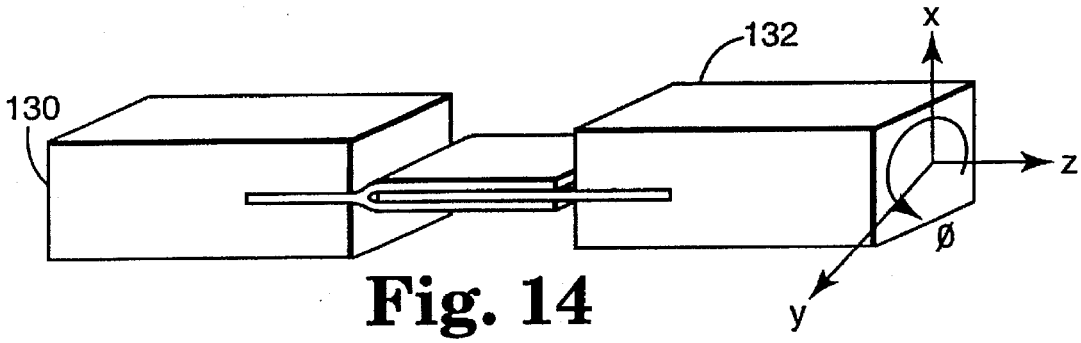

Referring now to FIGS. 13 and 14, a fastener of the type described in Example 1 and a fastening method as described in U.S. Pat. No. 5,201,101, using single-sided structured surface fasteners, were both tested to determine the lateral force or twisting displacement required to separate two fastened articles using each of the fastening methods. FIG. 13 shows the test set up for the prior art single sided fastener and FIG. 14 shows the corresponding test set up for the fastener of the present invention.

A series of tests were run to determine the angular dependence of the lateral force or twisting displacement required to separate two engaged, structured surface members using the two fastening methods. An Instron Model 4302 for precision tensile testing of the elastic and failure modes of materials was used to determine the lateral separation forces. An NRC Model RSX-2 precision rotational drive with on-axis mount was used to measure twisting displacement.

Test samples were identical rectangular strips of PVC film with plasticizers. The dimensions of the fastener strips were 5.08 cm (2 inches) long and 1.27 cm (0.5 inches) wide. The test strips relating to the prior art single-sided fasteners had a first broad smooth surface, and a second broad structured surface, and having a total thickness of 864 μm (34 mils). The test strips relating to the fastener of the present invention, as described in Example 1, had a total thickness of 1422 μm (56 mils). The rectangular test strips were cut such that the sides of the strips would form an angle theta with the longitudinal axis (e.g. L and M) of the structured surface of one member of the fastener, the other member of the fastener being cut such that the sides of the strips would be parallel to the longitudinal axis of the structured surface. Angle theta varied between zero (0) and forty-five (45) degrees. Thus, the axes of the structured surfaces of the two members of the fasteners were misaligned when fastened with the sides of the rectangular strips aligned.

FIGS. 13 and 14 schematically illustrates how the fasteners were tested using the Instron described above. Each fastener was engaged in frictional attachment by about a 20 Newton (4.5 lb.) force exerted by a smooth-rubber-surfaced metal roller. In each test, the engaged samples were mounted in opposing clamps such that the clamps held the samples just outside of the overlapping, engaged regions. The area of overlap in all cases was a square defined by the width of the samples, 1.27 cm (0.5 inches), or a 1.27 cm (0.5 inch) overlap.

Lateral force separation measurements were performed via translation motion along the z-axis in the plane of the sample surfaces, as shown in FIGS. 13 and 14. One member of the fastener was attached to a stationary clamp 130 and the other member was clamped to a movable clamp 132. As a result, only the shear force parallel to the plane defined by the engaged region was measured. Twist angle separation measurements were performed via angular displacement about the z-axis, as shown in FIGS. 13 and 14. One member of the fastener was clamped to a stationary member 130 and the other strip was mounted to a rotatable clamp 132. The second strip was rotated in order to determine the maximum twist survivable before the engaged region became separated.

The lateral separation force, or tensile strength, was evaluated at a variety of misalignment angles between 0° and 45° for each method of fastening. The lateral separation force was determined by measuring the maximum load per sample width at the point of separation. The test data shows that the bond strength is higher for misalignment angles roughly in the range of zero (0) to twenty (20) degrees for both fasteners. The fastener of the present invention, however, exhibited a significantly higher tensile strength as compared to the prior art fastener. The results of the tests are summarized in the following table. These values represent the average of four trials for each sample type and misalignment angle.

Tensile Testing

| | misalignment | max. load at separation (lbs./in.) |
|---|---|---|
| prior art fastener | 0° | 3.15 |
| | 7.5° | 3.86 |
| | 15° | 3.74 |
| | 30° | 2.15 |
| | 45° | 1.72 |
| present invention fastener | 0° | 5.09 |
| | 7.5° | 5.22 |
| | 15° | 5.34 |
| | 30° | 3.74 |
| | 45° | 1.68 |

The twist angle, phi ϕ, required to separate engaged samples was also measured for each fastener for a variety of misalignment angles between 0° and 45°. The twist angle was increased in a step-wise fashion at a rate of 2.5° per step. After each step the engaged region was visually examined for signs of bond separation. If no separation was observed, the angle was advanced another step. Upon initial separation, the angle phi was noted and termed phi initial (ϕ initial). Phi initial determines the twist angle at which bond separation is nucleated, usually at a location such as a corner. After the phi initial determination, the twist angle was again advanced in the same step-wise fashion until complete separation of the fastener was achieved. At this point, the angle phi was noted as phi final (ϕ final). Phi final represented the twist angle required to completely separate the engaged fastener without applying shear force along the z-axis. The test data shows that the amount of twist before initial and complete separation is higher for misalignment angles roughly in the range of zero (0) to thirty (30) degrees for both fasteners. The amount of twist survivable after initial separation and before complete separation was much greater for the fastener of the present invention than for the prior an fastener for a given misalignment. These results are summarized in the following table which represents an averaging of four tests per alignment and sample bonding type.

Twist Testing

| | misalignment | ϕ initial | ϕ final | Δϕ |
|---|---|---|---|---|
| prior art fastener | 0° | 85 | 125 | 40 |
| | 7.5° | 95 | 170 | 75 |
| | 15° | 105 | 190 | 85 |
| | 30° | 65 | 125 | 60 |
| | 45° | 55 | 70 | 15 |
| present invention fastener | 0° | 100 | 250 | 150 |
| | 7.5° | 150 | 350 | 200 |
| | 15° | 140 | 315 | 175 |
| | 30° | 95 | 235 | 140 |
| | 45° | 55 | 165 | 110 |

The present invention has now been described with reference to several embodiments thereof. It will be apparent to those skilled in the art that many changes or additions can be made in the embodiments described without departing from the scope of the present invention. Thus, the scope of the present invention should not be limited to the structures described in this application, but only by structures described by the language of the claims and the equivalents of those structures.

We claim:

1. A fastener comprising:

a first member having a first and second major surface, said second major surface opposite said first major surface, at least a portion of said first and second major surfaces being a first structured surface, said first structured surface including a first plurality of tapered elements, each element having at least one side inclined relative to a common plane at an angle sufficient to form a taper, said first plurality of tapered elements being situated to form a plurality of axes including at least one first first member longitudinal axis on said first major surface and said second major surface of said first member has a second first member longitudinal axis wherein said first first member longitudinal axis situated at an angle relative to said second first member longitudinal axis so as to form different angularly oriented pattern of said tapered elements;

a second member having at least one major surface at least a portion of that surface being a second structured surface, said second structured surface including a second plurality of tapered elements, each element having at least one side inclined relative to a common plane at an angle sufficient to form a taper, said second plurality of tapered elements being situated to form a plurality of axes including at least one second member longitudinal axis;

said first and second members being fastened together with said first member longitudinal axes of said first and second major surfaces situated at an angle relative to said second member longitudinal axis such that at least two of said tapered elements on said first major surface of said first member or on said second member are torsionally twisted relative to their relaxed, unfastened position, and such that at least two of said tapered elements on said second major surface of said first member or on said second member are torsionally twisted relative to their relaxed, unfastened position, and said inclined sides of one of said first and second major surfaces' of said first member and second member's tapered elements being frictionally adhered to at least one of said inclined sides of the other of said first and second major surface's of said first member and second member's tapered elements.

2. The fastener according to claim 1, wherein said first member further comprises means for providing support to said first member.

3. The fastener according to claim 1, wherein said second member further comprises means for providing support to said second member.

4. The fastener according to claim 3, wherein said means for providing support to said second member is a nonwoven disposed opposite said second structured surface.

5. The fastener according to claim 2, wherein said means for providing support to said first member is a nonwoven disposed between said first and second major surfaces.

6. The fastener according to claim 1, wherein in an unfastened position, said first and second structured surfaces comprise solid frusto-pyramidal-shaped elements having polygonal-shaped cross-sections.

7. The fastener according to claim 6, wherein said polygonal-shaped cross-sections are squares.

8. The fastener according to claim 6, wherein said polygonal-shaped cross-sections are rectangular.

9. The fastener according to claim 6, wherein said polygonal-shaped cross-sections are hexagonal.

10. The fastener according to claim 1, wherein in an unfastened position, said first structured surface comprises solid frusto-pyramidal-shaped elements having a polygonal-shaped cross-section and projecting from said common plane and said second structured surface comprises surfaces defining a cavity having a polygonal shaped cross-section and recessed from said common plane.

11. The fastener according to claim 10, wherein said polygonal-shaped cross-section of said first member comprises a hexagon and said polygonal-shaped cross-section of said cavity comprises a triangle.

12. The fastener according to claim 1, wherein in an unfastened position, said first structured surface comprises surfaces defining a cavity having a polygonal-shaped cross-section and recessed from said common plane and said second structured surface comprises solid frusto-pyramidal-shaped elements having a polygonal-shaped cross-section and projecting from said common plane.

13. The fastener according to claim 12, wherein said polygonal-shaped cross-section of said second member comprises a hexagon and said polygonal-shaped cross-section of said cavity comprises a triangle.

14. The fastener according to claim 1, wherein one of said first and second member's tapered elements are constructed from a polymeric material.

15. The fastener according to claim 1, wherein said tapered elements of one of said first and second major surfaces of said first member are constructed from a polymeric material and wherein a portion of said second member's taper's elements are constructed from a polymeric material.

16. The fastener according to claim 15, wherein in an unfastened position, said first and second structured surfaces comprise solid frusto-pyramidal-shaped elements having a square-shaped cross-section defining a diameter and a top surface defining a height measured from said common plane, and said elements are spaced to define a pitch wherein:

said height is approximately equal to 2.74 times the diameter;

said pitch is approximately equal to 1.43 times the diameter;

said height is measured between said common plane and a top or bottom of the element;

said diameter is measured as the length of the side of square-shaped cross-sections; and said pitch is equal to the diameter plus a distance between the frusto-pyramidal-shaped elements.

17. The fastener according to claim 1, wherein said angle between said first and second longitudinal axes is between zero (0) degrees and about twenty (20) degrees.

18. The fastener according to claim 17, wherein said angle is preferably seven and one-half(7.5) degrees.

19. The fastener according to claim 1, further comprising electrical connection means for providing an electrical connection when said first and second members are fastened.

20. The fastener according to claim 19, wherein said electrical connection means comprises:

a first electrically conductive path, at least a portion of said first electrically conductive path exposed on one of said first and second major surfaces of said first member;

a second electrically conductive path, at least a portion of said second electrically conductive path exposed on said at least one major surface of said second member;

wherein said first and second electrically conductive path are oriented such that they form an electrical connection when said first and second members are fastened together.

21. The fastener according to claim 1, wherein said second member has a first and second major surface, at least a portion of said first and second major surfaces being said second structured surface.

22. The fastener according to claim 21, wherein said first major surface of said second member has a first second member longitudinal axis and said second major surface of said second member has a second second member longitudinal axis.

* * * * *

UNITED STATES PATENT AND TRADEMARK OFFICE

CERTIFICATE OF CORRECTION

PATENT NO.: 5,634,245

DATED: June 3, 1997

INVENTOR(S): Forrest J. Rouser and Jon A. Kirschoffer

It is certified that error appears in the above-identified patent and that said Letters Patent is hereby corrected as shown below:

Col. 2, line 4,delete "o" after the word "the" and before the word "longitudinal".

Column 4, line 18, delete the word "is".

Column 9, line 7, delete "often" and insert therefore --of ten--.

Column 9, line 47, delete "dement" and insert therefore --element--.

Column 12, line 46, delete "an" and insert therefore --art--.

Signed and Sealed this

Second Day of December,1997

*Attest:*

Bruce Lehman

BRUCE LEHMAN

*Attesting Officer*

*Commissioner of Patents and Trademarks*